US006191706B1

(12) United States Patent
Kositkun

(10) Patent No.: US 6,191,706 B1
(45) Date of Patent: Feb. 20, 2001

(54) PARKING GUIDE FOR USE WITH A GARAGE DOOR OPENER

(76) Inventor: Araya Kositkun, 22706 Cheryl Way, Lake Forest, CA (US) 92630

( * ) Notice: Under 35 U.S.C. 154(b), the term of this patent shall be extended for 0 days.

(21) Appl. No.: 09/450,529

(22) Filed: Nov. 29, 1999

(51) Int. Cl.[7] ..... B60Q 1/48

(52) U.S. Cl. ..... 340/932.2; 340/933; 340/686; 340/539; 340/550; 340/551; 340/552

(58) Field of Search ..... 340/932.2, 933, 340/686, 550, 551, 552

(56) References Cited

U.S. PATENT DOCUMENTS 3,874,322 * 4/1975 Brauer ..... 116/28 R
4,383,238 * 5/1983 Endo ..... 340/32
4,665,378 * 5/1987 Heckethorn ..... 340/51
5,052,113 * 10/1991 Aquino ..... 33/264
5,184,132 * 2/1993 Baird ..... 341/176
5,617,087 * 4/1997 Scott ..... 340/932.2
5,883,579 * 8/1999 Schreiner et al. ..... 340/686

* cited by examiner

*Primary Examiner*—Daniel J. Wu
*Assistant Examiner*—Hung Nguyen
(74) *Attorney, Agent, or Firm*—W. Edward Johansen

(57) ABSTRACT

An optical parking guide includes a container, a mounting element, either a laser diode or a light emitting diode and a control circuit. The mounting element is pivotally coupled to the container. The laser diode is disposed within the mounting element. The control circuit couples the laser diode to the garage door opener. The control circuit turns on the laser diode in response to the presence of a car with a front window and a dashboard so that the laser diode generates an output light. The mounting element directs the output light through the front window onto the dashboard of the car so that a driver of the car can guide the car into the car's parking place.

1 Claim, 3 Drawing Sheets

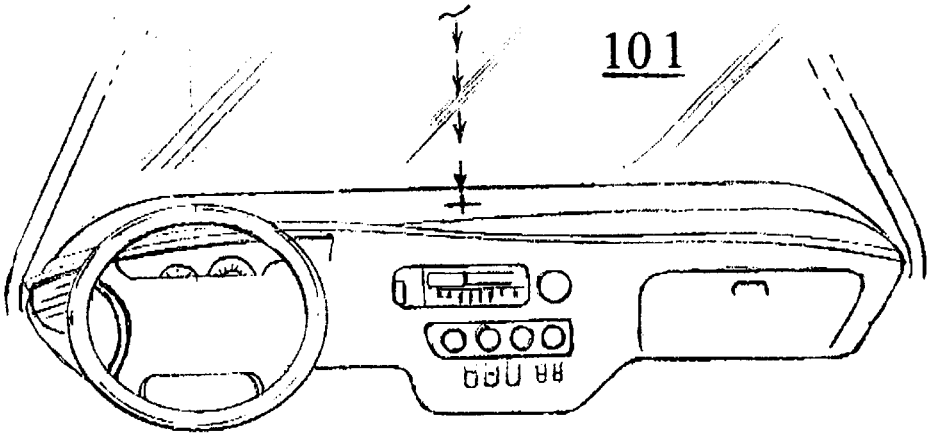
Fig. 3.
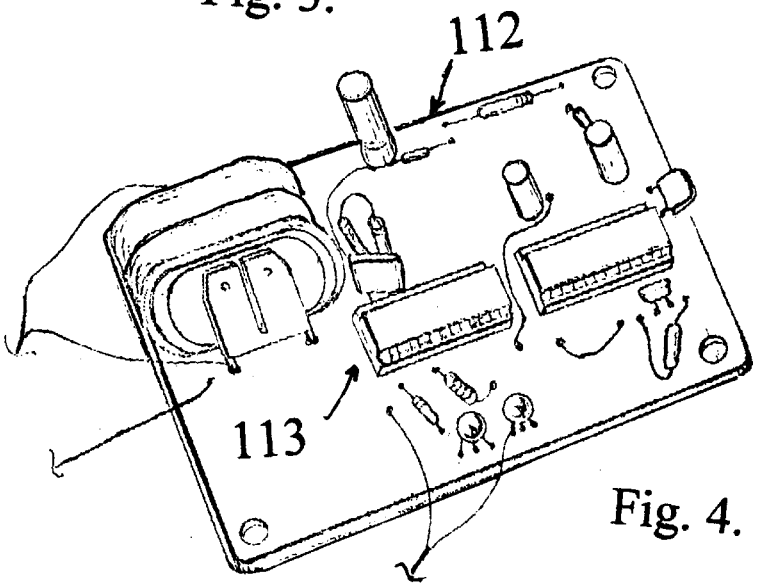
Fig. 4.
Fig. 5.
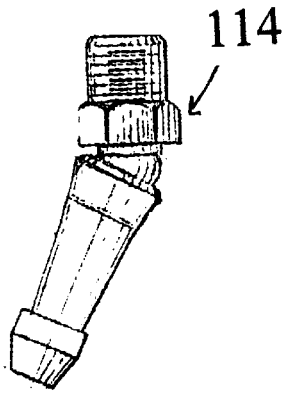
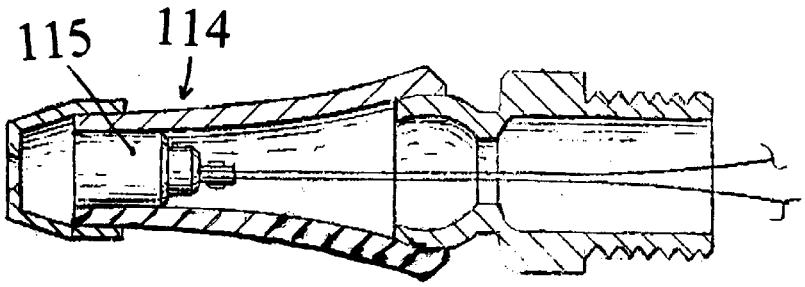
Fig. 6.

PARKING GUIDE FOR USE WITH A GARAGE DOOR OPENER

BACKGROUND OF THE INVENTION

The field of the invention is parking guide for use with a garage door opener.

U.S. Pat. No. 4,808,997 a photoelectric vehicle position indicating device which is for use in parking and otherwise positioning vehicles and is employed to assist in parking and otherwise positioning a vehicle on a supporting surface. A photoelectric control unit is mounted on an overhead structure spaced above the supporting surface and has a beam emitting device for directing a light beam downwardly for interception by the vehicle, while minimizing the likelihood of interception by pedestrians, pet animals and other moving things. The light beam is initially reflected back to a photoelectric transducer on the control unit by a reflective device or mirror. The light beam is pulsed so that the transducer supplies electrical pulses to an amplifier that is correspondingly gated. When the vehicle interrupts the light beam, the amplifier produces a beam interruption output signal which causes a one-shot timer to energize an alarm device, through an output relay. The operator then stops the vehicle in the desired position. The one-shot timer de-energizes the alarm device after a brief interval. Alternatively, the mirror is not employed, and the light beam is not significantly reflected back to the transducer until the light beam is intercepted by the vehicle, whereupon reflection from the vehicle produces a reflected light beam to the transducer. The corresponding pulsed signals from the transducer operate the amplifier, which is modified so that it actuates the timer, whereby it energizes the alarm device for a timed interval.

U.S. Pat. No. 5,841,368 teaches a parking assist device which is removably affixed in relation to a surface and is adapted to engage the on coming wheels of a vehicle and provide upon being engaged by the wheels of a vehicle a signal to the operator to stop the vehicle. The signal may be produced by either a mechanical mechanism or an electrical apparatus.

U.S. Pat. No. 5,945,907 teaches a sensing and indicating device. The device is mounted at a fixed location to determine the distance between the sensor and an approaching vehicle. The sensor provides visual and/or audible indication of the distance between the vehicle and the sensor. The driver of the vehicle uses that displayed or audible information to locate the vehicle within a defined space or envelope, e.g., within a garage. The sensor and indicator may also be located laterally with respect to the vehicle so that the distance between the vehicle side and the sensor can be determined whereby the vehicle can be located laterally within the defined space or envelope.

U.S. Pat. No. 4,218,157 teaches a visual vehicular parking aid which includes a plurality of vertically suspended position indicators to direct a person driving an automobile into a parking space when the normal pavement markings are not visible or present.

U.S. Pat. No. 4,965,571 a motor vehicle driver-indicator guide-device for signifying when it is safe to advance which includes a support structure mounting a light signaling structure and mechanism therefor, that displays a signal light viewable by a driver of a motor vehicle with an actuating lever which the bumper actuates. A green light of the light signaling structure has an electrical circuitry and an electrical switch that is normally closed providing a go signal evidencing that further advancement of the motor vehicle may be continued, actuation of the actuating lever serving to open the normally closed electrical switch when the actuation switch is pressed beyond a predetermined position indicative of maximum allowable forward advancement permissible for the advancing motor vehicle, the support structure having a tape mounted thereon carrying an adhesive backing for mounting the mounting structure on an upright surface of a wall or the like, the green light carrying a symbol viewable when the switch is closed indicative of permissive further advancement.

U.S. Pat. No. 3,874,322 teaches a movable vehicle parking position indicator. The indicator moves in conjunction with a garage door used to close off the parking area. As the garage door is opened, a ball-like indicator is lowered into a position clearly visible from the driver position of a vehicle entering or properly parked in the garage. As the door is closed, the indicator is retracted.

U.S. Pat. No. 5,285,205 teaches a vehicle-guidance and positioning system. The system utilizes a laser. The emitted beam from the laser is directed over the path along which a vehicle is to be guided. The laser beam impinges on a target area located on the vehicle in such a manner that the impingement of the laser beam on the target is continuously observable by the vehicle's operator. The operator steers the vehicle so that the laser beam continuously impinges on the target area until the vehicle reaches a pre-selected position in a confined space such as a garage, a drive-through service lane and a loading dock.

U.S. Pat. No. 5,343,376 teaches a laser pointer which includes a laser module fitted into a conductive cylindrical casing and attached with a laser firing lens assembly and connected to a battery set and controlled by a switch to fire a laser beam for pointing. The laser module includes a focus adjusting element threaded into the inner thread on the cylindrical shell thereof whereby rotating the focus adjusting element on the cylindrical shell in either direction causes change of distance between the lens of the laser firing lens assembly and the laser diode of the laser module so that the focus is adjusted. The switch has a switching control press rod for switch control and for fastening to the pocket as the laser pointer is not in use.

U.S. Pat. No. 5,406,395 teaches an optical parking alignment system which includes at least one projector located on a vehicle for projecting a respective image forwardly of the vehicle. The alignment of the vehicle is indicated when each respective image is in focus on a screen disposed in front of the vehicle. The projector includes either a transparency and an imaging lens or a hologram and a narrow-band light source.

U.S. Pat. No. 5,127,357 teaches a garage parking guide which assists a driver to park very conveniently in the same desired location of an enclosure, such as, a garage. The guide consists of an adjustable mirror and housing affixed adjacent to the garage door opening for the purpose of reflecting the vehicle's brake lights and/or view of rear bumper to the driver via the vehicle's side view mirror. The guide, properly positioned, will direct a visual image, to the driver, indicating the vehicle's relative position to the garage opening. As the vehicle enters the garage, the brake lights, will reach a predetermined alignment with that of the parking guide, so as to transmit the glow of the brake lights to the driver signifying that the vehicle has reached the final predetermined position. The vehicle guide will function with any vehicle and/or driver, once properly mounted, for any space equipped with a parking guide. The guide is capable of providing three images to the driver: normal for most occasions, magnified if driver wishes a larger brake light image, and wide angle for use when different with varying heights of brake lights from the floor use the same parking space. One parking guide must be used for each parking space. For example, a two car garage would require two parking guides, one for each side of the garage.

U.S. Pat. No. 5,617,087 teaches a parking device for vehicles entering a ceiling-covered parking garage which includes a housing. The housing substantially encloses an electrical circuit. The electrical circuit includes a light-emitting bulb and a switch. The switch opens and closes the electrical circuit to light and unlight the bulb. A power supply and a cord suspend the housing from the ceiling of the parking garage so that the housing may intercept the vehicle to be parked, close the switch of the circuit, thereby emitting a light signal to the driver of the vehicle to let the driver know that the vehicle has reached the predetermined parking position.

U.S. Pat. No. 5,227,785 teaches a vehicle parking assist apparatus which includes a hollow mounting base, an elongated signaling device, such as an upright pole having a signal light mounted thereto, supported on the base for pivotal movement from a normal upright non-signaling position to a tilted signaling position upon being contacted by an advancing vehicle, and an electrical circuit connected to the signal light of the elongated signaling device and capable of being switched from an open circuit condition to a closed circuit condition for electrically actuating the signal light to provide a visible alerting signal for a driver of the advancing vehicle. A coupling device supports the pole upright on the base and also couples the signal light to the electrical circuit. The coupling device is capable of retaining the electrical circuit in an open circuit condition so long as the signaling device is disposed in the upright non-signaling position. The coupling device is further capable of switching the electrical circuit to the closed circuit condition in response to the elongated signaling device being contacted and tilted by the advancing vehicle to the tilted signaling position.

U.S. Pat. No. 4,145,681 a parking guide and signaling device for cars and trucks to assist the driver parking a vehicle in a designated parking area which includes a housing section having a window in the front wall thereof which is closed by a pane of translucent sheet material through which indicia can be seen clearly when the indicia are illuminated from the rear surface of the pane by an electric light with electrical apparatus within the housing for illuminating the pane and the housing section having pivotally mounted thereon an actuating lever biased so that the electrical apparatus is normally "off" but when the vehicle moves into a designated parking area the electrical apparatus is turned "on" and an intense beam of light illuminates the inner surface of the pane.

U.S. Pat. No. 3,998,285 a vehicle indicating mechanism, in the form of a parking guide, which gauges the back clearance of an automobile or similar vehicle. The parking guide includes a hollow, translucent guide rod, which is movable responsive to a motor within a control box, from a substantially horizontal position, adjacent to the back bumper of the vehicle, to a substantially vertical position, extending upwardly from the corner of the bumper. The guide rod is illuminated by a light within the control box when the rod is in the vertical position thereby also enabling the rod to be viewed by the driver and used as a guide for parking the automobile at night.

U.S. Pat. No. 5,177,479 teaches a garage parking position indicator which is operable on principles of wave energy. A wave energy detector such as an infrared receiver is mounted to one side of the garage access door at a point displaced from the rear wall of the garage by a distance greater than the length of the vehicle. A wave energy source, such as an infrared transmitter, is mounted on the opposite side of the garage access door from the receiver. The transmitter and the receiver are mounted at a height suitable for cross-secting the traveling vehicle from his leading edge to its trailing edge, preferably from bumper to bumper. The transmitter constantly transmits and directs wave energy toward the receiver so that the presence of any portion of the vehicle between the transmitter and the receiver will interrupt reception of the wave energy by the receiver.

U.S. Pat. No. 5,882,106 teaches a thin profile laser pointer assembly which includes a thin profile laser head, a constant voltage laser diode driver circuit and a coin cell power source all packaged within a thin-profile rectangular housing having a thickness between about 2.0 mm and about 6.0 mm. The laser head includes a thin, rectangular heat sink and a laser diode mounted on a recessed shelf on a front edge of the heat sink. The laser head is slidably received in a mounting channel in a front portion of the housing. The arrangement of the laser head and mounting channel rigidly fixes the laser diode in the X and Z axes while permitting sliding linear movement of the laser diode along a "Y" axis, which defines the optical axis of the laser diode. A lens is mounted in the mounting channel along the optical axis, and a projecting aperture is formed in the front edge of the housing in front of the lens for allowing the laser beam to exit through the front of the housing. The laser beam is focused by sliding the laser head within the channel. The laser diode driver circuit and a contact switch are mounted on a circuit board received and secured over the housing. Contact pads on the circuit board engage corresponding contacts on the battery and laser head assembly to complete the circuit. The constant voltage power regulating circuit utilizes a simple shunt regulator circuit which monitors voltage drain as the battery decays and draws appropriate current levels to provide constant power to the laser diode.

U.S. Pat. No. 4,638,433 teaches a micro-processor controlled garage door operator which eliminates lower and upper limit switches on the garage door in that the upper and lower limits are set in a program mode of the microprocessor with up and down control switches by the operator. The settings of the door are stored in the memory of the microprocessor. The microprocessor also sets the force limits by establishing them slightly above the actual force required to move the door up and down and this prevents the forces to be set greater than required which could result in a dangerous condition. An external security switch is also connected to the microprocessor of the garage door operator to allow the door to be opened by those knowing the code. In program mode, the user enters in the four digit code and the four numbers are stored.

U.S. Pat. No. 5,697,700 teaches a handy laser pointer which includes a cylindrical cassing coated with a layer of phosphorescent substance and having a transverse through hole, a laser firing cap fastened to the front end of the casing by plugging, a rear end cap fastened to the rear end of the casing by a screw joint and having a hanging hole for hanging, an insulative sleeve mounted inside the casing, a laser module holder mounted inside the casing and abutted against the insulative sleeve, a battery set mounted in the insulative sleeve and connected to the rear end cap and a laser module mounted inside the casing and fastened to the laser module holder, the laser module including a circuit board fastened to the laser module holder and having a switch, a laser generator connected to the circuit board and controlled by the switch to emit a laser beam through the laser firing cap, a button mounted in the transverse through hole of the casing and adapted for switching the switch, a metal spring connected between the circuit board and the battery set.

U.S. Pat. No. 5,656,900 teaches a garage door operator which has an electric motor controlled by a control unit. A transmission is connected to the motor to be driven thereby to open and close a garage door. An infrared obstacle detector is connected to the control unit and includes a unitary infrared pulse emitter and an infrared detector. A missing pulse detector is coupled to the infrared detector to generate a door opening signal if the door is closing when the pulses are absent due to the infrared being interrupted by an obstacle or not having been generated. The control unit receives the door opening signal and causes the electric motor to open the garage door.

U.S. Pat. No. 5,633,778 teaches an infrared signal interface which enables an infrared detector module to communicate with the door edge signal input of a garage door operator. The infrared signal interface has a power supply for driving the pulsed infrared detector. Pulsed signals are received by a missing pulse detector that controls a relay. The relay may be coupled to the door edge signal of the garage door operator.

SUMMARY OF THE INVENTION

The present invention is generally directed to an optical parking guide for use with a garage door opener.

In a first separate aspect of the invention the optical parking guide includes a mounting element with a laser diode and a control circuit which couples the laser diode to the garage door opener.

Other aspects and many of the attendant advantages will be more readily appreciated as the same becomes better understood by reference to the following detailed description.

The features of the present invention which are believed to be novel are set forth with particularity in the appended claims.

DESCRIPTION OF DRAWINGS

FIG. 3 is a partial perspective of the window of the car of FIG. 2 having a dashboard which is optically coupled to the optical parking guide.

FIG. 4 is a perspective drawing of a board with a control circuit of the optical parking guide of FIG. 1.

FIG. 5 is a perspective drawing of a mounting element of the optical parking guide of FIG. 1.

FIG. 6 is an elevation view in cross-section of the mounting element of the optical parking guide of FIG. 5 with a laser diode.

DESCRIPTION OF THE PREFERRED EMBODIMENT

Figure 1:
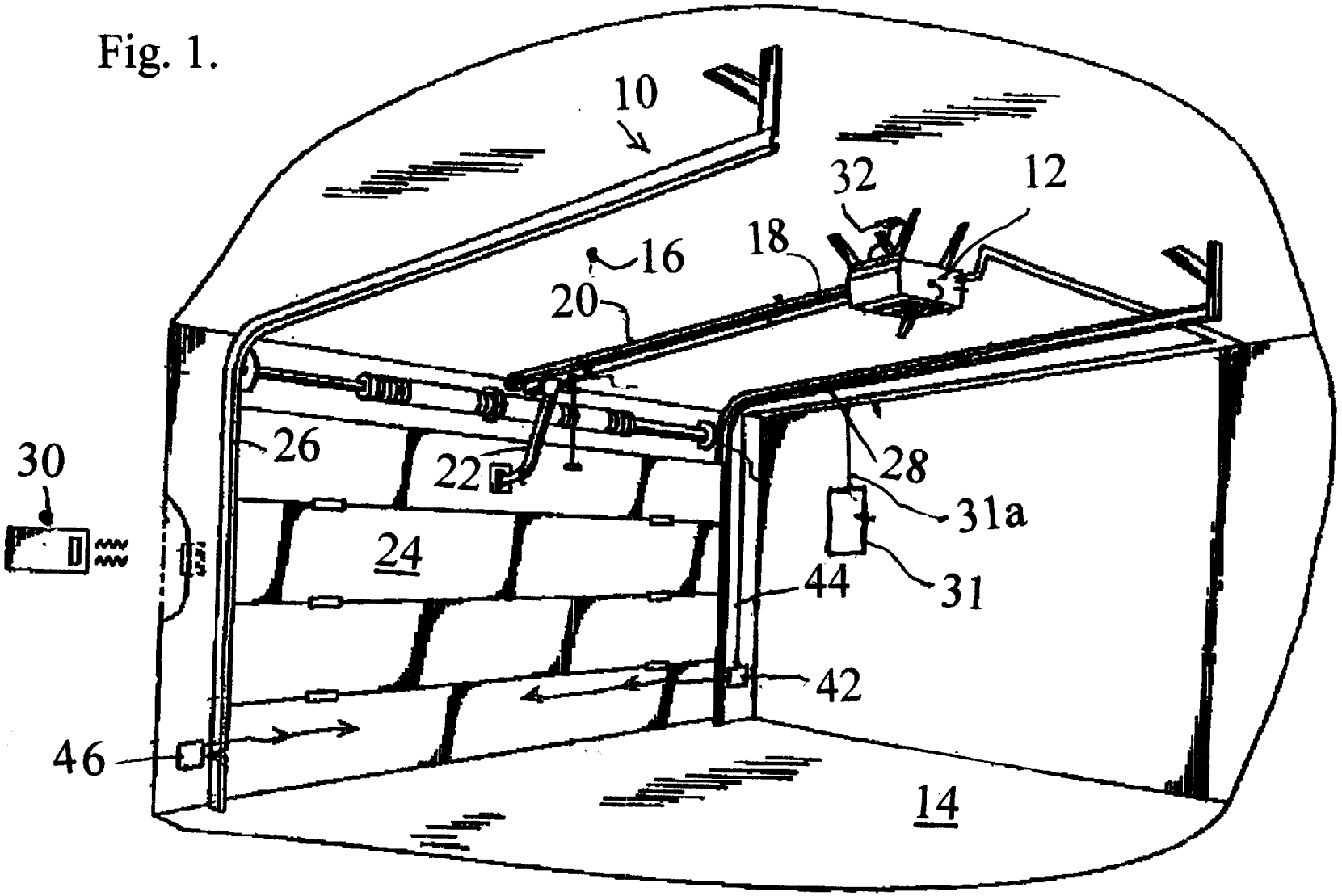
FIG. 1 is a perspective drawing of an optical parking guide for use with a garage door opener according to the present invention.
Figure 2:
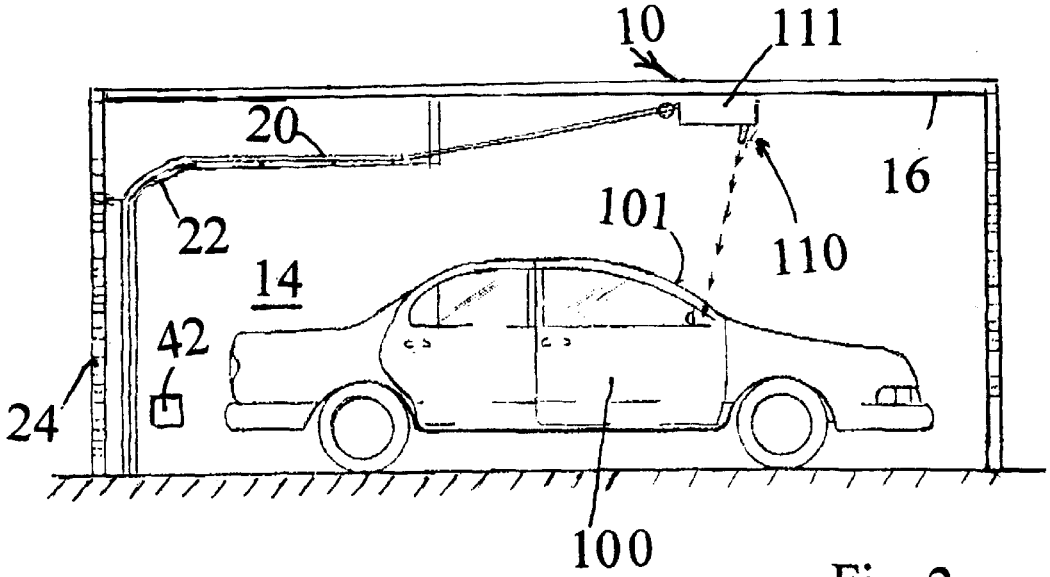
FIG. 2 is a side elevation view of a car having a front window and the optical parking guide for use with a garage door opener of FIG. 1.

Referring to FIG. 1 in conjunction with FIG. 2 a garage door opener 10 includes a head unit 12 mounted within a garage 14 on a ceiling 16. A transmission includes a screw drive 18 which extends from the control head 12 and has a disconnectable trolley 20 connected thereto. An arm 22 is connected to the trolley and is connected to a multi-panel garage door 24 for opening and closing the garage door. The garage door is carried on a pair of L-shaped channels 26 and 28 as is conventional for multi-panel garage doors. A radio transmitter 30 may communicate by radio frequency energy with an antenna 32 extending from the head unit 12 to cause the head unit 12 to open and close the garage door. An inside control panel 31 may communicate over a wire 31*a* with the head unit 12. A permanently mounted keypad radio transmitter 34 may also communicate with antenna 32 of the head unit to command the head unit to open and close the door. A combination photo-emitter and detector 42 is connected by leads 44 to the head unit to receive electrical energy therefrom. An infrared reflector 46 is positioned at the opposite door edge to receive and reflect back infrared energy to the photo-emitter and detector 42.

Referring to FIG. 2 in conjunction with FIG. 1 and FIG. 3 a car 100 has a front window 101 and a dashboard 102. An optical parking guide 110 is optically coupled to the dashboard 102 through the front window 101.

Referring to FIG. 4 in conjunction with FIG. 2 and FIG. 5 the optical parking guide includes a container 111, a board 112 with a control circuit 113 and a light mounting element 114.

Referring to FIG. 5 in conjunction with FIG. 3 and FIG. 6 the light mounting element 114 has either a laser diode 115 or a light emitting diode. The dashboard 102 is optically coupled to the laser diode 115.

Again referring to FIG. 2 in conjunction with FIG. 3 and FIG. 6 the control circuit 113 couples the laser diode 115 to the garage door opener 10. The control circuit 113 turns on the laser diode 115 in response to the presence of a car so that the light emitting diode generates an output light. The mounting element 114 directs the output light through the front window 101 onto the dashboard 102 of the car 100 so that a driver of the car 100 can guide the car 100 into the car's proper parking place.

Figure 7:
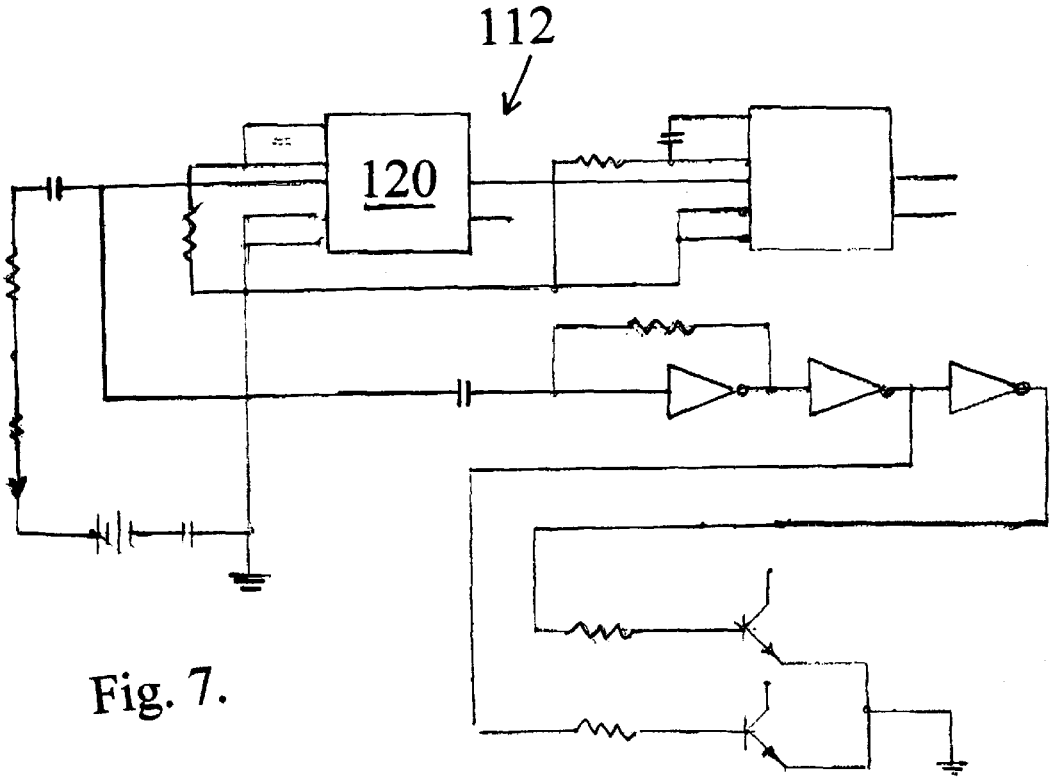
FIG. 7 is a schematic diagram of the control circuit of the optical parking guide of FIG. 1.

Referring to FIG. 7 a schematic diagram of the control circuit 112 of the optical parking guide 110 includes a timer 120.

From the foregoing it can be seen that an optical parking guide for use with a garage door opener has been described.

Accordingly it is intended that the foregoing disclosure shall be considered only as an illustration of the principle of the present process.

What is claimed is:

1. An optical parking guide for use with an optical sensor which is disposed on the side of a garage door and a garage door opener which opens the garage door, said optical parking guide comprising:

a. a container mechanically coupled to the garage door opener;

b. a mounting element pivotally coupled to said container;

c. a light emitting diode mechanically coupled to said mounting element; and d. a control circuit electrically coupled to said light emitting diode whereby said control circuit turns on in response to a car passing said optical sensor wherein said car has a front window and a dashboard so that said light emitting diode generates an output light and whereby said mounting element directs said output light through the front window onto the dashboard of the car so that as driver of the car can guide the car into the car's proper parking place.

* * * * *